United States Patent [19]

Foellner

[11] 4,118,924

[45] Oct. 10, 1978

[54] DISPLAY SYSTEM FOR WATCHES AND THE LIKE

[76] Inventor: Donald M. Foellner, 201 Swarthmore Ave., Folsom, Pa. 19033

[21] Appl. No.: 788,695

[22] Filed: Apr. 18, 1977

[51] Int. Cl.[2] ..... G04B 19/30; G08B 23/00; G04B 11/06

[52] U.S. Cl. ..... 58/127 R; 58/50 R; 340/324 M; 362/23

[58] Field of Search ..... 58/50 R, 127 R; 240/2.1; 340/324 M; 362/23, 29

[56] References Cited

U.S. PATENT DOCUMENTS

| | | | |
|---|---|---|---|
| 2,172,765 | 9/1939 | Kollsman | 240/2.1 |
| 2,173,316 | 9/1939 | Sproule | 240/2.1 |
| 2,536,557 | 1/1951 | Levesque | 58/50 |
| 2,988,631 | 6/1961 | Hershey et al. | 240/2.1 |
| 3,005,907 | 10/1961 | Dupree | 240/8.16 |
| 3,590,773 | 7/1971 | Ruppert | 116/129 |

FOREIGN PATENT DOCUMENTS 1,295,071 11/1972 United Kingdom.

*Primary Examiner*—Edith S. Jackmon
*Attorney, Agent, or Firm*—Woodcock, Washburn, Kurtz & Mackiewicz

[57] ABSTRACT

An improved form of illuminated display, particularly for electric wristwatches and the like. A light-reflecting dial face is provided, and a plurality of prisms formed of light-transmitting plastic arranged thereon. A miniature incandescent lamp is attached to the underside of a transparent cover or crystal for directing illumination upon the reflecting surface. An angled surface of the prism directs the light reflected thereon from the reflecting surface upwardly through indicia formed at the top of each prism. In a preferred embodiment, the indicia are formed by raised numerals, the radially inward halves thereof being inclined with respect to the reflecting surface. Watch hands are formed of translucent plastic, and have inclined lower surfaces with reflecting material thereon to allow the hands to be illuminated by the miniature lamp.

5 Claims, 5 Drawing Figures

DISPLAY SYSTEM FOR WATCHES AND THE LIKE

BACKGROUND OF THE INVENTION

The present invention relates to improved displays for indicating instruments, and more particularly to a display system for an electrical instrument in which raised numerals are illuminated by reflected light.

With the advent of miniature electric batteries and electrically-driven watch movements it has become possible to construct electric wristwatches and the like of conveniently small size. Further, the introduction of light emitting diodes, or LED's as they are commonly known, has allowed watch manufacturers and others to provide illuminated alphanumeric displays which can be operated by the same electric battery used to drive the instrument.

Several limitations inhere in the conventional LED-type of display such as used in conventional watches and calculators. For one thing, LED displays usually require a relatively high current flow, which places an undue strain upon the small batteries which are used. Further, LED-type of readouts are substantially planar, and are often difficult to read from an oblique angle due to the parallax effect which arises. Finally, the conventional, red LED displays are difficult to read in sunlight. This causes a user to keep the display energized longer than desirable, increasing the drain on the instrument battery.

Although alternative types of electrically-illuminated displays are known, prior art displays commonly require more illumination than it is feasible to drive with present-day miniature batteries. Various types of "light pipes" and related light-transmitting glass and plastic members are known; however, it will be recognized that the inherent losses occasioned by the transmission of light through an extended body of glass or plastic further reduce the illumination available, and accordingly require a more powerful source of illumination.

Conventional approaches to illuminating indicia by reflected light usually utilize a bulb or the like which shines upon the indicia to illuminate them. Again, however, this approach is wasteful of light energy, and aside from requiring an inordinate amount of electrical energy is necessarily large and bulky. This renders it unsuitable for use in miniature readouts such as are necessary for watches and the like.

Finally, conventional illuminated readouts of the low-power type, such as LED displays, cannot be read unless they are illuminated inasmuch as the display and background elements are practically indistinguishable when the unit is not energized.

Accordingly, it will be appreciated that it would be highly desirable to construct an illuminated miniature display which is small in size, and which requires only a relatively small amount of electric power for energization.

It is therefore an object of the present invention to provide an improved, illuminated alphanumeric display.

Another object is to provide an improved illuminatable display for electric wristwatches and the like.

Yet another object is to provide a display which can be illuminated under low-light conditions, yet is easily readable under ambient light, without other illumination.

SUMMARY OF THE INVENTION

Briefly stated, in accordance with one aspect of the invention the foregoing objects are achieved by providing a planar substrate having a reflective surface upon which are arranged a group of translucent plastic prisms. The prisms are provided with generally upright faces aligned toward a miniature electric lamp attached to a transparent crystal overlying the substrate, and enclosing prisms. The sides of the prisms remote from the lamp are inclined with respect to the reflective surface, and the uppermost surfaces of the prisms are relieved to form numerals. In order to illuminate the numerals the miniature lamp is energized, directing light against the reflective surface wherefrom it is reflected to the inclined surfaces of the prisms. The latter in turn re-reflect the illumination upwardly through the numerals to illuminate them.

In a preferred embodiment one or more indicating hands are rotatably supported within the prisms, and formed of light-transmitting plastic. Preferably, the hands are triangular in cross section, having a pair of lower surfaces inclined with respect to the reflecting surface of the substrate and coated with a reflecting material.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings, in which:

DESCRIPTION OF A PREFERRED EMBODIMENT

Figure 1:
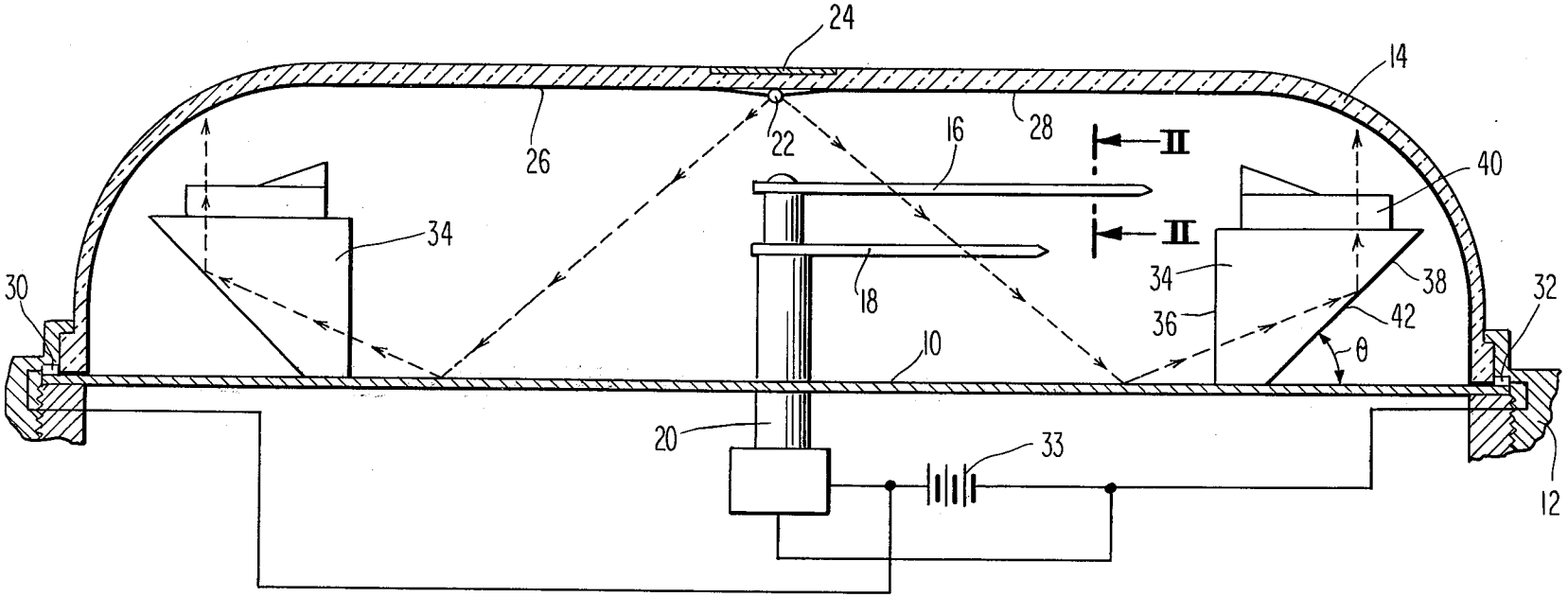
FIG. 1 is a cross-sectional diagram of a watch face constructed according to the invention.

A cross-sectional view of a typical electric watch is shown in FIG. 1. A generally planar watch face or substrate 10 extends across the face of the watch, being received in an appropriate groove in the watch case 12. Crystal 14, whose periphery is also received in watch casing 12, extends above face 10 in the usual manner to enclose hands 16 and 18. The watch hands are mounted upon rotatable member 20 which is driven by an appropriate movement (not shown).

Disposed at approximately the center of crystal 14, and preferably within the crystal, is a miniature electric lamp 22. An opaque member 24, which may be formed by a small dot of silver paint, overlies the lamp to prevent outwardly-directed light from the lamp from obscuring the watch face, and further to re-reflect the light downwardly toward face 10. Electric current is supplied to the lamp through a pair of thin conductors 26, 28 which may comprise fine wires embedded in the undersurface of the crystals; or thin strips of conductive paint, as appropriate. The conductors, which may be insulated from the upper surface of face 10, may make contact with appropriate terminals 30, 32 provided within the watch case. Appropriate leads then extend from the terminal to a conventional miniature battery 33 disposed within the watch casing, here shown in schematic form.

Arranged in a circle about the periphery of face 10 are a plurality of prisms 34. Each prism has a radially inward face 36 which is generally upright with respect to the watch face, as shown. A remote, radially outer face 38 of each prism is inclined at an angle $\theta$ to the reflective surface of the watch face. The lower surface of the prism is attached to the face 10 by appropriate means, such as cement; or the planar watch face and prism may be integrally formed from a common element of plastic or the like. Finally, the upper face of the prism is relieved to form a numeral 40.

Due to the upstanding, relieved nature of the numerals formed at the uppermost surface of each prism the numerals can be easily read in ambient light, without the need for additional illumination. To further facilitate the visibility of the numerals, the portions of the upper surface of the prisms lying about the numerals should be painted with a dark, opaque coating; a flat black finish is preferred. By forming prisms 34 of a light-colored translucent material, such as Plexiglas of yellow or orange, visibility of nonilluminated numerals is still further enhanced.

Under low light conditions a switch 41 or button on the watch is closed to energize miniature lamp 22. Miniature lamp 22 is preferably an incandescent lamp which exhibits a transverse dimension of approximately 0.016 inches. In a preferred embodiment a microminiature lamp model no. 40,689, available from the Edmund Scientific Co. of Barrington, N.J., is used although it is within the purview of the invention to use other equivalent light sources. This lamp operates on a 1.5 v power supply and draws a 15 ma current to produce 60 millilumens. Also, while light-emitting diodes (or LEDs) may be used, state-of-the-art LEDs conventionally draw more current than do incandescent bulbs of the type described, and accordingly place an inordinate drain upon the battery.

Light emanating from lamp 22 is directed downwardly, as shown, and reflected from the surface of face 10. Equivalently, if face 10 and prisms 34 are molded of a common piece of translucent plastic, it may be advantageous to provide a reflecting surface to the underside of the watch face. In either case the impingent light is reflected upwardly, as shown, to strike the radially outward, inclined surfaces 38 of the prisms. The latter surfaces are advantageously polished, and coated with a reflecting material 42. The light which strikes the inclined, outer surfaces is re-reflected upwardly to exit through numeral 40 and then crystal 14. In this manner each numeral of each prism is illuminated by the single, centrally-disposed lamp 22 through the mechanism of re-reflection.

In a preferred embodiment the hands 16, 18 are formed of an orange or yellow-orange acrylic plastic such as Plexiglas. Plexiglas, a trademark for an acrylic plastic produced by the Rohm & Haas Co., Philadelphia, Pa. is a preferred and easily-available material; however, it will readily be recognized that other, similar materials may be substituted.

Figure 2:
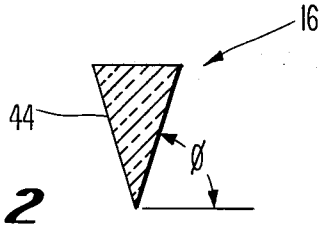
FIG. 2 is a view of an indicating hand taken at II—II of FIG. 1.

FIG. 2 shows in cross-sectional detail the configuration of hand 16, which is also typical of hand 18. As is the case with prisms 34, the hands are advantageously formed of translucent plastic of orange or yellow-orange color. The upper surfaces of the hands, that is, that surface oriented toward the light source, is substantially flat. The lower surfaces of the hands form a V-shape, as shown, in order to better reflect light penetrating the hand from above. Each of the lower surfaces of the hands forms an angle $\phi$ with the horizontal (here taken to be the reflective surface of face 10 of the watch).

In addition, a coating 44 is applied to the lower surfaces of the hands. The coating, which may be white paint, serves as a reflective surface to cause incident light to be re-reflected upward and thus in effect to illuminate the body of the watch hand.

Figure 3:
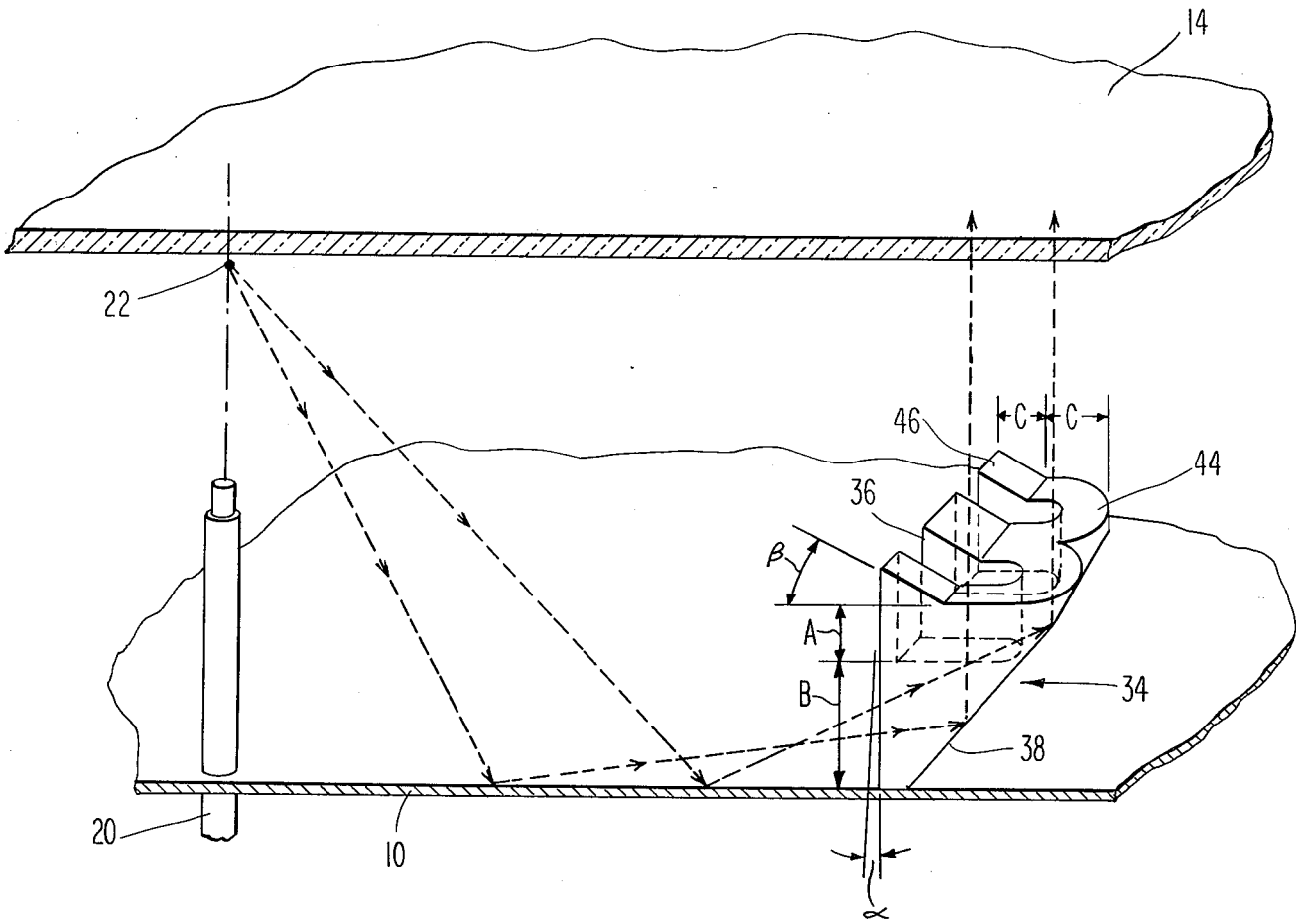
FIG. 3 is a perspective view illustrating the principles of the invention.

Turning now to FIG. 3, there is shown in further detail a raised numeral of the type contemplated by the present invention. Light source 22, herein represented as a point source, is situated beneath the surface of a crystal 14 to direct light downwardly upon reflective substrate 10. Where the indicia are arranged in a substantially circular display, such as in the case of a watch, lamp 22 is disposed coaxially with the post 20 which rotatably supports the hands of the watch. It should be recognized, however, that the specific placement of the lamp is not critical to the practice of the invention and it will be recognized that other arrangements, such as those utilizing a plurality of light sources, may be used to illuminate indicia of the type described.

It has been found that upstanding face 36 which confronts lamp 22 should be disposed at a slight angle $\alpha$ to the vertical, as shown. In a preferred embodiment angle $\alpha$ approximates 10°. This angle enhances the ability of the numeral to "catch" light reflected from the surface of planar member 10. Light entering upstanding face 36 then traverses the body of the prism, as shown, and is re-reflected from distal angled face 42. As disclosed hereinabove, face 38 is coated with a reflective material to increase the incidence of light illuminating the numeral. The light reflected from surface 38 then exits upwardly from the numeral to illuminate the display.

An important part of the present invention is the relieved or recessed character of the numeral formed upon the upper surface of each prism. Each numeral comprises a flat upper surface 44 and, in a preferred embodiment, an angled upper surface portion 46. The depth A of the relief defining the numeral, as measured from flat upper surface 44, is advantageously one-third the total height of the flat upper surface as measured from substrate 10. Accordingly, dimension A is twice the value of dimension B. It has been discovered that this proportion produces excellent visual characteristics, and enhances the visibility of the numeral in both ambient light, and when illuminated by means of lamp 22.

Yet another important aspect of the present invention is the inclination of the inner one-half of the relieved numeral. Surface 44 extends across approximately the radially outer one-half of the numeral, while inclined surface 46 comprises the radially inner one-half of the numeral. Accordingly, the widths of the surfaces, herein shown as dimension C, are substantially equal. The angle b at which inclined surface 46 meets with upper surface 44, and accordingly with the reflective surface of substrate 10, is advantageously 30°. The inventor has found that inclining the inner half of the numeral as shown increases the visibility of the numeral from locations towards the side of the display, substantially diminishing the otherwise-present parallax effect and substantially increasing the readability of the display as a whole. As was the case with FIG. 1, the relieved surfaces surrounding the numeral are coated with an opaque material, such as a flat black paint. The lowermost surfaces of the prisms are fastened to substrate 10 by appropriate means, such as cement.

Figure 4:
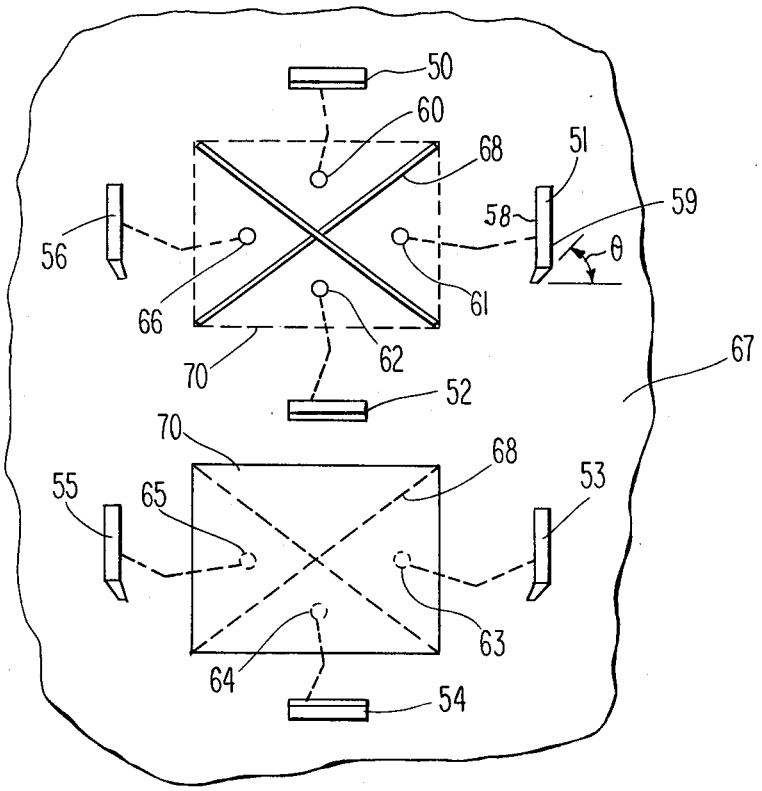
FIG. 4 illustrates one display embodying principles of the present invention.

FIG. 4 illustrates a form of seven-bar display constructed in accordance with principles of the invention. A group of elements 50–56 are disposed in the usual manner, so that any given alphanumeric character may be formed by selectively illuminating ones of the elements. Each element conforms generally to the construction of prisms 34 as shown in FIGS. 1 and 3. Each of the elements is formed of a light-transmitting material such as acrylic plastic. The plastic, which may be clear or tinted, is formed to have a substantially upright inner face 58 and an outer face inclined at some angle $\theta$. The inclined, outer surface of each of the members is advantageously coated with a reflective material, such as white paint. A plurality of miniature incandescent bulbs of the type described in connection with FIGS. 1 and 3 are disposed inwardly of each of the display elements. Accordingly, lamps 60–66 are associated with elements 50–56, as indicated. Moreover, the various members are positioned upon a reflective substrate 67, which may for example be the face of a watch or similar instrument. Light rays, in dotted form, then extend from the various miniature lamps and reflect upwardly from reflective substrate 67 so as to strike the innermost, upstanding faces of elements 50–56. As will now be appreciated the light rays pass through the innermost, upstanding face of each element and reflect from the outward, angled face thereof so as to be directed vertically upward (out from the plane of the Figure), thus illuminating the display elements.

In order to prevent cross-modulation, herein defined as the illumination of one display element by a miniature lamp other than the one directly associated with it, a cross-shaped reflective partition 68 is provided. The partition may be formed from a single, molded element; or from a pair of planar members crossing one another, substantially as shown. The purpose of these members is to keep light from lamps which are non-adjacent a display element from partially illuminating that element. For instance, in the absence of partition 68 if lamp 60 is energized at least part of the light energy therefrom will likely reflect from surface 67 and thus be transmitted to display elements 51 and 56, partially illuminating them. By providing a partition to both the upper and lower portions of the illustrated display light from each of the lamps is isolated and concentrated upon the proper display element. Moreover, by providing a reflective surface to the sides of the partition the effect is enhanced, so that practically all of the light generated by each lamp is directed toward the corresponding display element.

To further concentrate the light energy produced by the lamps and enhance the viewability of the display, each of the partitions and associated lamps is covered with an opaque shield 70. The opaque shield may, for instance, be constituted by a small rectangle of opaque material disposed on the inside surface of a watch crystal or instrument lens; or, it may be a discrete, planar element secured to the upper edges of partition 68. The present inventor has found that such a barrier will, be preventing light from lamps 60–66 from escaping outwardly toward an observer, assist in providing a relatively dark background about the display elements and thus enhance their visibility. In addition, and as described with respect to the partitions 68, the underside of shield 70 may be provided with a reflective coating for still further concentrating the light energy produced by the incandescent lamps thereunder.

It will be appreciated that as many alphanumeric displays as needed may be provided, FIG. 4 merely illustrating one such unit. A watch, for example, would require a set of four such units in order to display hours and minutes simultaneously; or, two such units to display either the hour or the minutes.

Figure 5:
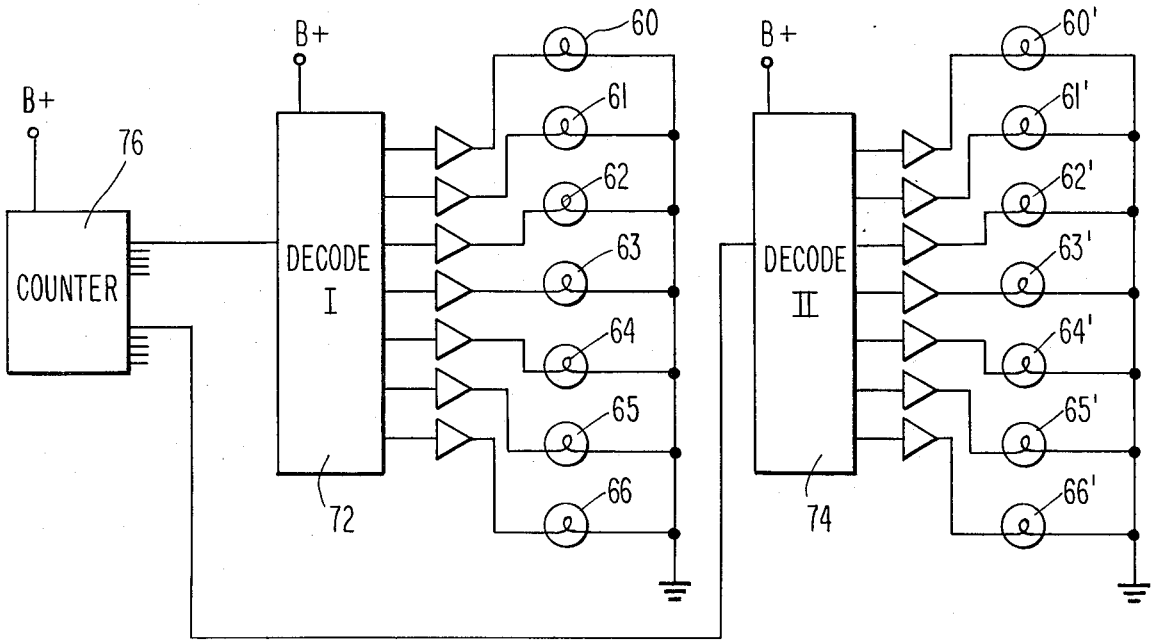
FIG. 5 illustrates one means of engerizing the display of FIG. 4.

FIG. 5 shows one means for energizing the lamps of a pair of seven-bar displays of the type shown in FIG. 4. The displays, herein denominated I and II, each comprehend a group of seven incandescent lamps 60–66 and 60′–66′. Each of the set of lamps is driven by a decoder, the decoder for set I being denominated 72, and that for set II being denominated 74. If necessary, an ampifier may be connected to each output terminal of each decoder 72, 74 for supplying adequate power to energize each lamp.

The decoders are operated by a counter 76 of any convenient type. The counter 76 may, for instance, comprise an oscillator powered by a miniature battery having a potential $B^+$. As is familiar to those skilled in the art, each decoder sequentially energizes certain ones of its output terminals in response to the accumulation of a certain number of pulses, or counts, from counter 76. In the present illustration a count of "1" will cause the second and fourth output terminals of decoder 74 to be energized, so that lamps 61′ and 63′ will illuminate their corresponding (rightwardmost) display elements. In order to display the number "88", both decoders 72 and 74 will energize all of the lamps associated therewith; and so on.

Accordingly, it will be appreciated that the specific sequence of illuminating various ones of a set of incandescent lamps may vary, in accordance with the counting system selected and the type of characters to be produced. It should therefore be understood that the specific decoding scheme described above is shown by way of illustration, not limitation.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. A display system for an electric watch or the like, comprising:

a generally planar substrate having a reflective upper surface;

a group of seven generally rectangular display elements formed of light-transmitting plastic and arranged upon said substrate so as to define a pair of contiguous rectangles;

a group of seven miniature incandescent lamps upstanding from said substrate and in close proximity to ones of said display elements;

a generally X-shaped partition of an opaque material upstanding from said substrate to substantially prevent light from all but one of said miniature incandescent lamps from striking ones of said display elements;

said display elements each having a first, generally vertical face confronting the nearest one of said incandescent lamps; and an opposed face disposed at some angle $\theta$ to the plane of said substrate, $\theta$ being less than 90°.

2. The invention as defined in claim 1, further including a second generally X-shaped partition, and first and second opaque shields disposed upon said partitions and extending generally parallel to said substrate.

3. The invention defined in claim 2, wherein said partitions are provided with reflective surfaces thereon.

4. The invention as defined in claim 3, wherein the surfaces of said first and second shields confronting said substrate are provided with a substantially reflecting coating.

5. The invention defined in claim 4, wherein said opposed faces of each of said display members are provided with a reflective coating.

* * * * *